United States Patent [19]

Sundaram et al.

[11] Patent Number: 4,687,570

[45] Date of Patent: Aug. 18, 1987

[54] DIRECT USE OF METHANE IN COAL LIQUEFACTION

[75] Inventors: Muthu S. Sundaram, Shoreham; Meyer Steinberg, Melville, both of N.Y.

[73] Assignee: The United States of America as represented by the United States Department of Energy, Washington, D.C.

[21] Appl. No.: 746,471

[22] Filed: Jun. 19, 1985

[51] Int. Cl.[4] ..... C10G 1/00

[52] U.S. Cl. ..... 208/431; 208/433; 208/107; 208/951

[58] Field of Search ..... 208/8 LE, 10, 11 R, 208/107, 11 LE, 431, 433, 951

[56] References Cited

U.S. PATENT DOCUMENTS

| | | | |
|---|---|---|---|
| 1,905,520 | 4/1933 | Steigerwald et al. | 585/943 |
| 1,922,918 | 8/1933 | Winkler et al. | 585/415 |
| 4,149,959 | 4/1979 | Bearden, Jr. et al. | 208/8 LE |
| 4,242,108 | 12/1980 | Snell | 208/8 LE |
| 4,303,496 | 12/1981 | Rudnick | 208/8 LE |
| 4,313,816 | 2/1982 | Veluswamy et al. | 208/8 LE |
| 4,334,976 | 6/1982 | Yan | 208/8 LE |
| 4,392,942 | 7/1983 | Wallman et al. | 208/8 R |
| 4,402,821 | 9/1983 | Yan | 208/8 LE |
| 4,404,083 | 9/1983 | Vasalos | 208/8 R |
| 4,412,908 | 11/1983 | Yamashita et al. | 208/8 R |
| 4,437,973 | 3/1984 | Huibers et al. | 208/8 LE |
| 4,448,668 | 5/1984 | Deering | 208/8 R |
| 4,605,487 | 8/1986 | Michel et al. | 208/408 |

OTHER PUBLICATIONS

*Encyclopedia of Chemical Technology*, vol. 5, pp. 42–47 (1979).

Fisher et al., "Primary Liquefaction of Coal by Hydrogenation", *Ind. Eng. Chem.*, vol. 29, No. 8, pp. 939–945 (1937).

Curran et al., "Mechanism of the Hydrogen-Transfer Process to Coal and Coal Extract," *Ind. Eng. Chem. Proc. Des. Dev.*, vol. 6, No. 166 (1967).

Neavel, "Liquefaction of Coal in Hydrogen-Donor and Non-Donor Vehicles", *Fuel*, vol. 55, No. 237 (1976).

Neavel, "Exxon Donor Solvent Liquefaction Process", *Phil. Trans. R. Soc. Land.*, A300, pp. 141–156 (1981).

Pullen, "Solvent Extraction of Coal", Rep. No. IC-TIS/TR16, pp. 15–16 (1981).

Baltisberger et al., "Carbon Monoxide-Water vs. Hydrogel for Liquefaction", *Prepr. ACS Div. Fuel Chem.*, vol. 24, No. 74 (1979).

Batchelder et al., "Evaluation of Use of Syngas for Coal Liquefaction," *Ind. Eng. Chem. Proc. Des. Dev.*, vol. 18, No. 4, pp. 594–599 (1979).

Farnum et al., "Analysis of Lignite Liquefaction Products Processed with Syngas and Hydrogen Sulfide", *Prepr. ACS Div. Fuel Chem.*, vol. 28, pp. 163–167 (1983).

Steinberg et al., "Make Ethylene and Benzene by Flash Methanolysis of Coal", *Hydrocarbon Processing*, vol. 6, Nov. 1982.

Sundaram et al., "Enhanced Ethylene Production via Flash Methanolysis of Coal", Bul. Report 34087 at 187th ACS Natl. Mtg., St. Louis, MO, Apr. 8–13, 1984.

*Primary Examiner*—Gary P. Straub

*Attorney, Agent, or Firm*—Vale P. Myles; James W. Weinberger; Judson R. Hightower

[57] ABSTRACT

This invention relates to a process for converting solid carbonaceous material, such as coal, to liquid and gaseous hydrocarbons utilizing methane, generally at a residence time of about 20–120 minutes at a temperature of 250°–750° C., preferably 350°–450° C., pressurized up to 6000 psi, and preferably in the 1000–2500 psi range, preferably directly utilizing methane 50–100% by volume in a mix of methane and hydrogen. A hydrogen donor solvent or liquid vehicle such as tetralin, tetrahydroquinoline, piperidine, and pyrolidine may be used in a slurry mix where the solvent feed is 0–100% by weight of the coal or carbonaceous feed. Carbonaceous feed material can either be natural, such as coal, wood, oil shale, petroleum, tar sands, etc., or man-made residual oils, tars, and heavy hydrocarbon residues from other processing systems.

8 Claims, 2 Drawing Figures

DIRECT USE OF METHANE IN COAL LIQUEFACTION

The U.S. Government has rights in this invention pursuant to Contract Number DE-AC02-76CH00016, between the U.S. Department of Energy and Associated Universities Inc.

BACKGROUND AND GENERAL DESCRIPTION

The liquefaction of coal to yield liquid and gaseous hydrocarbons has been known for some time. The main objective of coal liquefaction is to convert coal into a more efficient fuel that burns cleaner and is easier and less costly to transport. During the liquefaction process, the macromolecular network of the coal is broken into smaller units resulting in lighter products of reduced molecular weight. This involves an upgrading in the hydrogen content of the resulting products. Basically, liquefaction is accomplished by rapidly heating coal, slurried in a hydrogen donor vehicle, for considerably long residence times.

One of the earliest reported coal liquefaction processes was the Bergius process (1914) which used a paste of coal, heavy oil, and a small amount of iron oxide catalyst at 450° C. and 200 atmospheres in a stirred autoclave. This process was later refined by I. G. Farben in Germany to produce commercial quality gasoline during World War II. A similar process was used in Great Britain, developed by Imperial Chemical Industries, to hydrogenate coal to make gasoline but this process has not been in commercial use since 1958 and no process of coal hydrogenation is used commercially in either England or Germany today.

In the United States the solvent refining of coal was developed during the energy crisis in the late 1950s and a pilot demonstration plant was constructed which had an output of 45 tons per day, utilizing a slurry of coal which was taken up in process-derived anthracene oil and heated to about 425° C. at about 2000 psi of hydrogen for about 1 hour. After filtration, the major product produced was a low ash, low sulfur, tar-like heavy boiler fuel. This pilot plant was never put into commercial production.

Later, the H-Coal process was developed by Hydrocarbon Research, Inc., at Catlettsburg, KY. This pilot plant produced a product from a slurry of crushed coal and recycled oil which was treated with hydrogen in an ebulliated bed reactor at 200 atmospheres and about 455° C. with catalyst. Again, a commercial plant was never built incorporating this technology. More detail on this pilot plant can be found in Kirk-Othmer, *Encyclopedia of Chemical Technology,* 3d ed., 42–47 (1979).

To date, all existing processes for the direct liquefaction of coal by solvent extraction have utilized molecular hydrogen at high pressures (over 1000 psi). The total hydrogen consumption in these liquefaction processes is in the range of 3–5% of the amount of coal fuel, of which a significant portion comes from molecular hydrogen. The cost analysis of a typical coal liquefaction process shows that as much as one-third of the overall cost is devoted to hydrogen production. The considerable expense of hydrogen production is one of the significant drawbacks to commercial application of coal liquefaction technology.

By the present invention, applicants have developed a process that eliminates the need to use the costly molecular hydrogen in the liquefaction. Applicants have found that methane can be used in place of molecular hydrogen in the liquefaction process without significantly decreasing the yields of the desired oil products. The use of methane, in the form of natural gas, thus permits the use of an abundant natural resource to convert another abundant natural resource, coal, into usable fuel products. Natural gas is less expensive to use than molecular hydrogen derived from the gasification of coal or the reforming of methane.

In contrast to the prior art processes, which all represent hydrogenation processes, the instant invention accomplishes the liquefaction of carbonaceous materials such as coal in a pressurized methane atmosphere. Not only does the instant process have the economical advantages discussed above, it also has an advantage over the conventional hydrogenation approaches in curtailing the amount of unwanted $C_1$–$C_4$ hydrocarbon gas products formed during the liquefaction process. The ability to use the lower temperatures of the present invention in itself decreases the amount of gaseous product formed. In addition, the hydrogenation processes, which involve the hydrogen splitting of the aromatic ring structures in coal, liberate $C_1$–$C_4$ hydrocarbon gases as by-products. The present invention, which proceeds via alkylation reactions rather than hydrogenation, diminishes such splitting reactions and, therefore, decreases significantly the amount of $C_1$–$C_4$ hydrocarbon by-products and the improved yield of liquid products provides an important economic advantage and an improvement in the quality of the higher liquid content end product.

In the practice of the present invention, a preferred carbonaceous material is coal of the bituminous grade. This grade coal is preferred because in its inherent polynuclear structure under high temperature and pressure conditions, there are created the conditions of free radical liberation facilitating a reaction with methane. The methane reactant serves as a reservoir for hydrogen atoms which can be generated in situ to react with the free radicals from the liquefied coal which are developed during the early heating stages of the coal. Although methane gas is homogeneously stable at liquefaction temperatures, thermally produced free radicals from coal and the free radicals from the solvent can abstract a hydrogen atom from methane, thereby setting the stage for a variety of free radical reactions. The role of methane as the hydrogen reservoir becomes more important as the liquefaction process proceeds. During the initial stages of liquefaction, very little hydrogen is required to stabilize the free radicals generated from the coal. However, during the later stages of the liquefaction process, the hydrogen requirement is found to increase exponentially with coal conversion.

The instant invention thus presents a process for liquefying coal that is both efficient and cost effective.

DETAILED DESCRIPTION OF THE INVENTION

The present invention relates to a process for converting solid carbonaceous materials, especially coal, to liquid and gaseous hydrocarbons by treating said materials with methane, generally at a residence time of about 20–120 minutes, at a temperature in the range of from about 250° C. to about 750° C. and under pressure up to about 6000 psi. In a preferred embodiment, the liquefaction in the presence of methane is conducted at a temperature in the range of 350°–500° C. and at a pressure in the range of 1000–2500 psi. In another embodiment, methane is used directly at 50–100% by volume in a mix of methane and hydrogen.

A hydrogen donor solvent can be used in the liquefaction process as the liquid vehicle. The presence of the hydrogen donor solvent together with the methane in the slurry mix in the reactor increases the yields of the desired liquid and gaseous hydrocarbons. Hydrogen donor solvents suitable for use in the present invention include hydroaromatic solvents such as tetralin, tetrahydroquinoline, piperidine, indoline, perhydropyrene, pyrolidine, as well as hydrogenated anthracene oil, hydrogenated coal liquids, and similar solvents. The slurry vehicle serves both as a dispersant as well as a reactant. The carbonaceous feed materials that can be used in the present invention include natural raw materials, such as coal, wood, oil shale, petroleum, tar sands, and the like or man-made residual oils, tars, and heavy hydrocarbon residues from other processing systems.

The solid-liquid or liquid-liquid reaction mixture is fed into a reaction vessel and pressurized to elevated pressure. The reaction mixture may be preheated up to 350°, preferably to 200°–300° C., before introducing it into the reaction vessel. When the contents of the reaction vessel are heated to the reaction temperature, reaction occurs between the carbonaceous feed, solvent vehicle and the pressurizing methane gas. This results in the formation of new and useful products liquids.

The purpose of this invention is to provide a process in which the requirements for external gaseous molecular hydrogen are substantially reduced by substituting for it naturally occurring, abundant, high hydrogen containing methane. The use of methane, especially as natural gas, provides for a simple and more economical process than the prior art liquefaction processes that use molecular hydrogen. Furthermore, during liquefaction, the methane itself may be converted to more valuable higher hydrocarbons adding to the overall yield of useful products. The ability to use the recycled gas stream containing excess methane and other gaseous products in the liquefaction process reduces the cost of product gas separation-purification and the need for new gas feed.

THE PREFERRED APPARATUS

Figure 1:
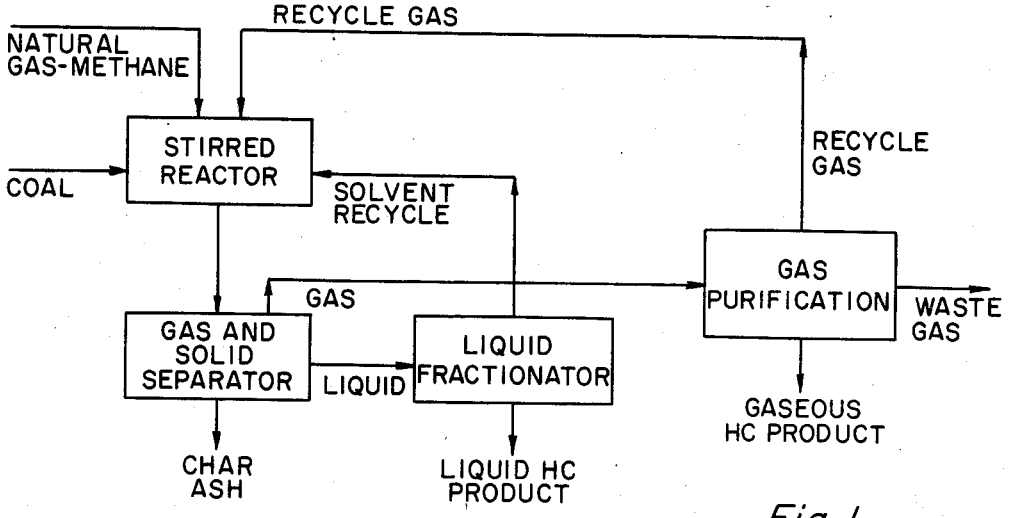
FIG. 1 is a process flow sheet for liquefaction of coal under high pressure by reaction with methane.

The flow sheet shown in FIG. 1 illustrates in diagrammatic manner the liquefaction of coal fed through the inlet labeled "Coal" into the Stirred Reactor which is also fed with a mixture of methane and natural gas under pressure conditions in a hydrogen donor solvent, such as tetralin. The ratio of tetralin to coal in the reactor is preferably ranging from about 1:1 up to about 4:1, being most preferably about 3:1 by volume. The reactor is pressurized from about 1000 psi up to about 6000 psi, preferably 1000 psi, and the temperature is quickly raised to a value of above 250° C., preferably 400°–450° C., but below 750° C., for a residence time of at least 20 minutes, preferably 30–50 minutes, during which time the solid coal is converted into liquid products and ash.

As shown in FIG. 1, the products of the reaction pass from the bottom of the reactor through the outlet line into a gas and solid separator in order to separate the ash, designated as Char Ash. The ash exists through the Char Ash line and the gas is taken off from the gas outlet line to the cooled gas purification vessel which vents the waste gas, condenses the refrigerated gaseous hydrocarbon products and recycles the recovered methane through the recycle line at the top. This recycled methane gas is fed back into the reactor, which permits the operation to be continuous.

The donor solvent, after reaction, is separated in the liquid phase from the gas and solid separator, passing through the liquid line into the Liquid Fractionator and the desired liquid product is taken off at the bottom of the Liquid Fractionator in the product line labeled Liquid HC Product (Hydrocarbon). The donor solvent recovered from the liquid phase in the Liquid Fractionator passes out of the top and through the solvent recycle line into the stirred reactor as recycled donor solvent. Additionally, the recycled solvent may be hydrogenated, catalytically or non-catalytically, before admission into the stirred reactor.

From FIG. 1 and the description, it will be seen that continuous operation is facilitated with small amounts of make-up donor solvent and with the saving of recycled methane.

EXAMPLE 1

This example was carried out in the stirred reactor shown in FIG. 1.

Figure 2:
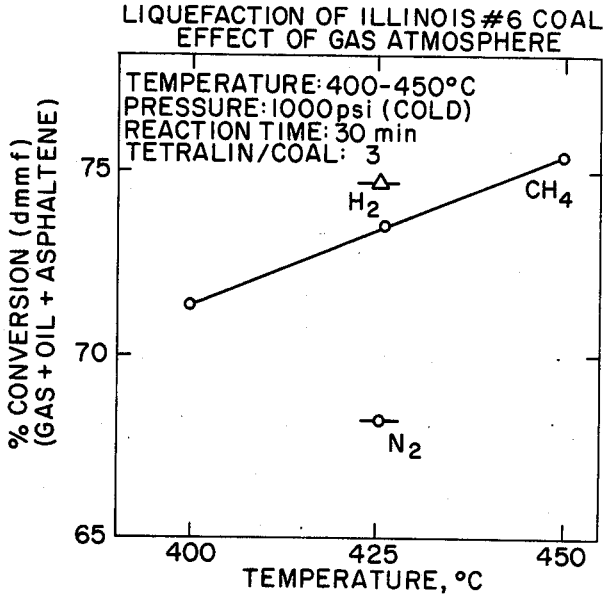
FIG. 2 is a graph showing the yields obtained by the practice of the process of the present invention using the specific reaction parameters set forth in Example 1.

The temperature of the reactor was adjusted to 400° C. after the reactor was charged with a coal slurry of Illinois #6 coal which was subjected to methane at a pressure of 1000 psi charged in the cold (room temperature 25° C.). The ratio of tetralin to coal in the slurry was 3:1 by volume. The percent conversion, on the basis of mineral matter for coal, is plotted on the Y axis of FIG. 2 and temperature readings starting at 400° C., then at 425° C. and finally at 450° C. show the yield going from 72%, to 74%, and 75% at these three values.

We claim:

1. A process for the liquefaction of carbonaceous materials to produce predominantly liquid hydrocarbons comprising heating said materials in a liquefaction reactor to a temperature in the range of 250° C. to 750° C., under pressure up to 6000 psi of a gas containing methane in the initial gas feed at 50–100% by volume for a residence time in the liquefaction reactor of about 20–120 minutes.

2. The process according to claim 1 wherein the liquefaction is carried out at 400°–450 C.

3. The process according to claim 1 wherein the gas employed is natural gas.

4. The process of claim 3 wherein hydrogen is added to the natural gas.

5. The process according to claim 1 wherein the solid carbonaceous feed material is selected from a member of a group consisting of natural raw materials, such as coal, wood, oil shale, petroleum, tar sands, and man-made residual oils, tars, and heavy hydrocarbon residues.

6. The process according to claim 5 wherein the solid carbonaceous material is coal.

7. The process according to claim 1 wherein the carbonaceous material is slurried with a donor solvent selected from the group consisting of hydroaromatic solvents and hydrogenated anthracene oil.

8. The process according to claim 7 wherein the hydroaromatic solvent employed is selected from the group consisting of tetralin, tetrahydroquinoline, piperidine, indoline, perhydropyrene, and pyrolidine.

* * * * *